US005899156A

United States Patent [19]

Schopf et al.

[11] Patent Number: 5,899,156

[45] Date of Patent: May 4, 1999

[54] THREAD CONTROL DEVICE FOR A CHAINSTITCH SEWING MACHINE

[75] Inventors: Dieter Schopf, Gerlingen; Hans-Dieter Bartholomä, Filderstadt, both of Germany

[73] Assignee: Union Special GmbH, Hemmingen, Germany

[21] Appl. No.: 08/841,897

[22] Filed: Apr. 17, 1997

[30] Foreign Application Priority Data

May 4, 1996 [DE] Germany ..... 196 17 945

[51] Int. Cl.[6] ..... D05B 49/00

[52] U.S. Cl. ..... 112/241; 112/302

[58] Field of Search ..... 112/241, 242, 112/245, 246, 312, 254, 255

[56] References Cited

U.S. PATENT DOCUMENTS

| | | | |
|---|---|---|---|
| 399,949 | 3/1889 | Tripp | 112/245 X |
| 1,583,925 | 5/1926 | Hemleb | 112/241 |
| 2,996,023 | 8/1961 | Pollmeier | 112/241 X |
| 3,408,970 | 11/1968 | Kakinuma | 112/245 |
| 3,460,494 | 8/1969 | Denker | 112/11 |
| 3,465,701 | 9/1969 | Walling | 112/245 |
| 3,641,958 | 2/1972 | Trageser | 112/241 |
| 4,457,247 | 7/1984 | von Hagen et al. | 112/302 |
| 5,386,791 | 2/1995 | Sato et al. | 112/302 |
| 5,404,824 | 4/1995 | Hiraoka et al. | 112/254 |
| 5,447,109 | 9/1995 | Karaba et al. | 112/302 |

*Primary Examiner*—Ismael Izaguirre
*Attorney, Agent, or Firm*—Brinks Hofer Gilson & Lione

[57] ABSTRACT

A thread control device for a chainstitch sewing machine comprises a thread feeder which is moved simultaneously with the stitching needle by the drive means for the stitching needle. The thread feeder is attached in such a manner as to be able to oscillate at a pivot drive which is allocated to a shaft rotatably mounted in the upper arm casing of the sewing machine.

14 Claims, 3 Drawing Sheets

1
34
35
17
19
21
26,27,33
36
37
44
12
41
39
32
28,42
24,25
29,31
23
22
43
38
16
18
12
13
15
14
11
10
9
8
12
7
4
2
3
5
6

FIG. 2
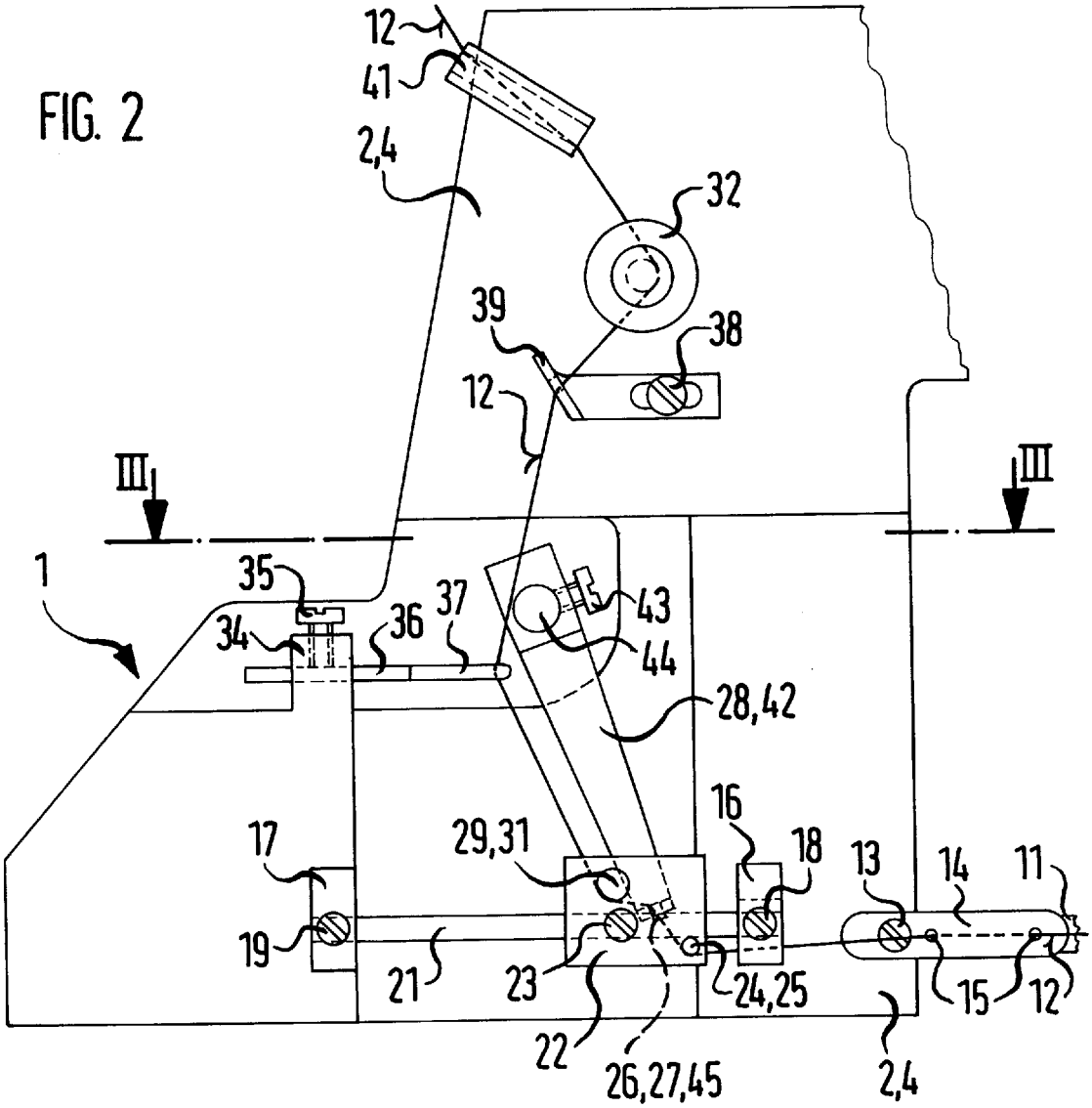
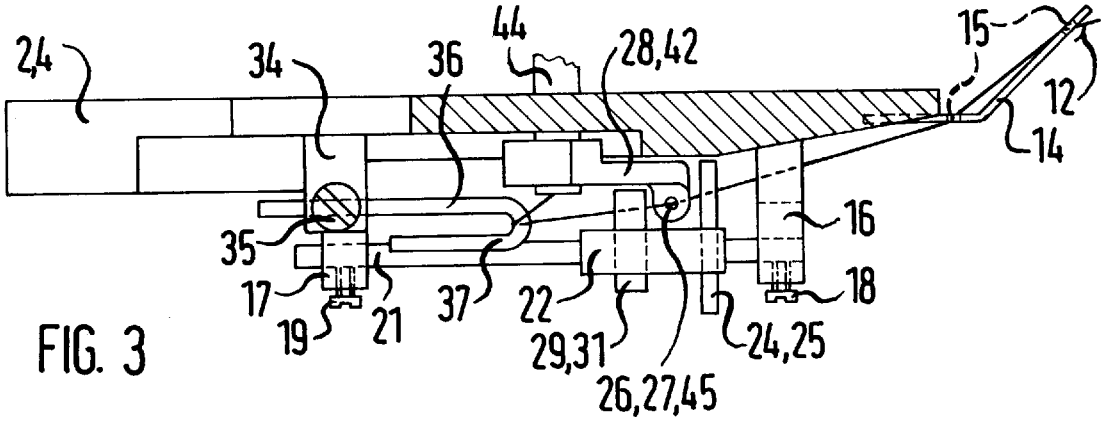
FIG. 3

THREAD CONTROL DEVICE FOR A CHAINSTITCH SEWING MACHINE

BACKGROUND OF THE INVENTION

The invention relates to a thread control device for a chainstitch sewing machine of the type including a rotatably mounted shaft, a reciprocating needle bar having a stitching needle including an eye through which the stitching thread is threaded, drive means connecting said rotatably mounted shaft to said reciprocating needle bar, a thread tensioning device and a thread feeder including a thread-guiding orifice.

A thread control device of this general type is disclosed in U.S. Pat. No. 3,460,494. In this prior art thread control device a guide eyelet, which serves to draw off or feed the thread, is attached to the needle bar. The stitching thread is threaded through the guide eyelet. A thread feeder of this type serves in a known manner in chainstitch sewing machines during the switch-forming procedure to both draw off a quantity of thread, from the thread supply, necessary to form the stitch and also to tighten the loose stitching thread required to form the needle thread loop.

Although the prior art thread feeder, which guides the thread and is connected to the needle bar, renders it possible for the parts to have a simple design, it does not allow any fine adjustments of the thread control device to suit the quantity of thread required during the individual phases of the stitch formation procedure. Furthermore, the total weight of the needle bar is increased owing to the thread feeder being fixedly attached to the needle bar. As a consequence the mass forces acting upon the needle bar drive are increased. This can cause premature wear of the sewing machine.

SUMMARY OF THE INVENTION

It is the object of the invention to design a thread control device of the type, suitable for drawing off the stitching thread from the stored thread and for tightening the stitching thread in the stitch already formed, in such a manner that it is suitable to produce a perfectly stitched seem even at high operating rates, in the region of up to 4000 stitches per minute, and with a needle bar stroke of approximately 60 millimeters.

This object is achieved in the case of a thread control device that consists of a pivot drive connecting the thread feeder to a rotatably mounted shaft such that the thread-guiding orifice of the thread feeder moves in an oscillating manner relative to the reciprocating movement of the stitching needle.

The oscillating movement of the thread feeder relative to the movement of the needle bar is made possible by the use of the swing drive which is allocated to the shaft and carries the thread feeder. This allows fine adjustments to be made to the drawing-off and tightening movements of the thread control device and thread feeder. Such fine adjustments are made to suit the quantities of thread necessary during the individual phase the stitch formation.

The preferred embodiment of the invention also provides a simple and convenient manner for sealing of the drive means for the stitching needle to prevent oil leakage from the sewing machine casing, since it is necessary to sees only the casing orifice for the oscillating shaft and the orifice for the needle bar.

BRIEF DESCRIPTION OF THE DRAWINGS

FIG. 2 shows a partial front view, pivoted 90°, with the thread feeder in the bottom dead center position.

FIG. 3 shows a transverse view along the line III as shown in FIG. 2.

DETAILED DESCRIPTION OF THE PREFERRED EMBODIMENT

Figure 1:
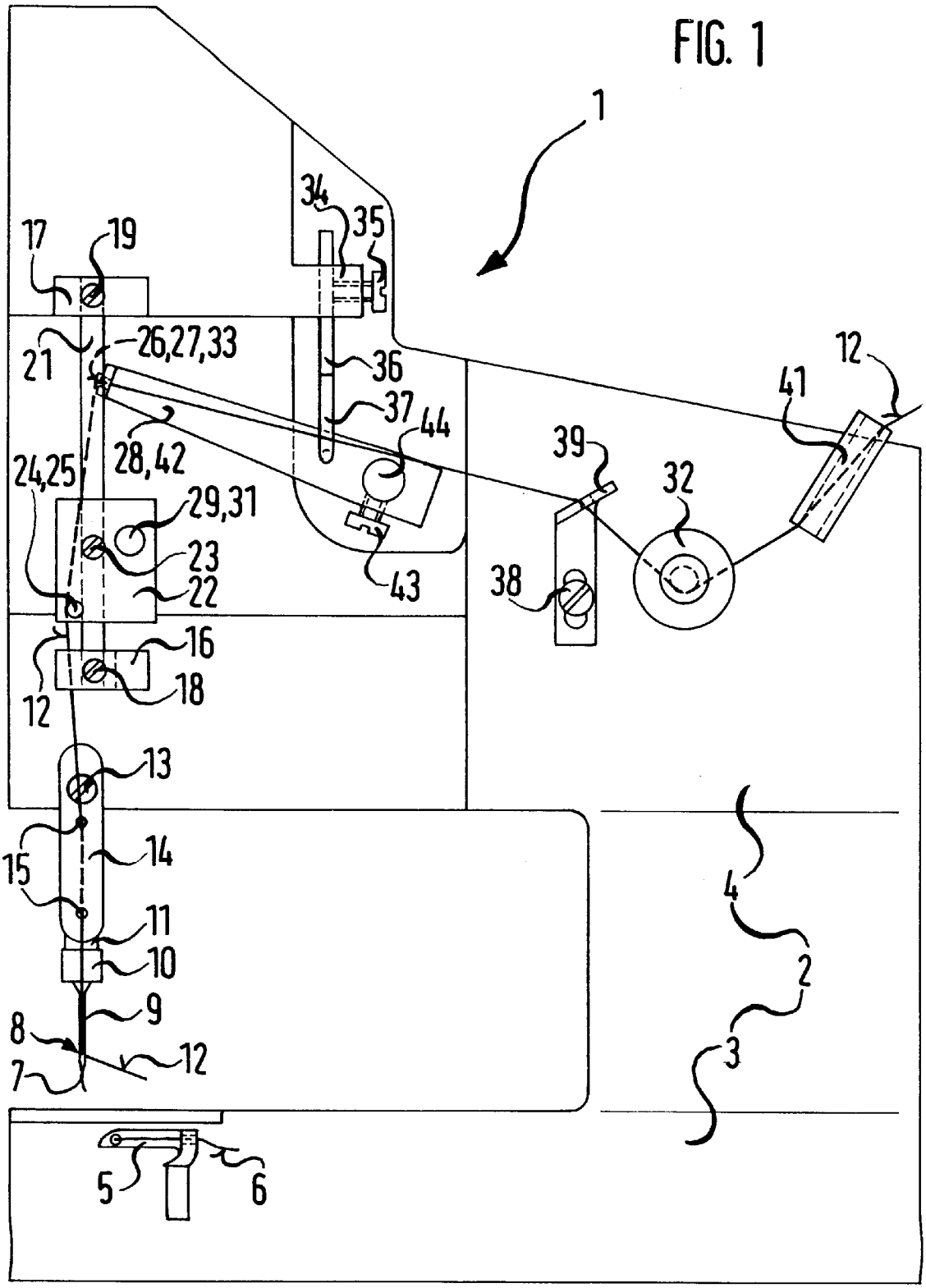
FIG. 1 shows a front view of a sewing machine with the thread control device thread feeder in the to dead center position.

Referring to FIG. 1, a chainstitch sewing machine 1 comprises a sewing machine casing 2 which consists of a tower casing part 3 and an upper arm casing 4. A looper 5 is mounted in the lower casing part 3 in a known manner and the said looper carries a looper thread 6 for the purpose of forming a double chain stitch. A looper thread 6 of this type is not necessary to produce a single chain stitch. The workpiece feed motion of the sewing machine 1 is performed likewise in a known manner.

The sewing machine 1 is equipped with a stitching needle 9 which moves in a reciprocating manner and is provided at its tip 7 with a needle eye 8. The stitching needle 9 is attached to the needle bar 11 by means of a nut 10. The needle eye 8 guides a stitching or needle thread 12. The looper 5 is actuated in a conventional manner such that it performs both movements at the and side to draw out and cast off the needle thread loop and lateral movements which serve to form a triangle of thread for the entry of the downwards moving stitching needle 9.

A bar 14, is attached to the upper arm casing 4 by means of a screw 13, includes orifices 15 through which the needle thread 12 is guided. The orifices 15 serve to calm the needle thread 12 which oscillates during the stitching procedure.

The upper arm casing 4 has brackets 16 and 17 secured thereto that have aligned apertures that receive a rod 21 attached by means of screws 18 and 19. A holder 22 is attached to the rod 21 in a height adjustable manner by means of a screw 23, the said holder supports a thread guide 24 in the form of a pin 25. The pin 25 is arranged in the path of the stitching thread 12 between the needle eye 8 and an orifice 26. The orifice 26 is in the form of an eyelet 27 at the free end of an oscillating thread feeder 28. The holder 22, which can also be designed in two parts, supports a further fixed thread guide 29 in the form of a pin 31 which is arranged in the path of the stitching thread 12 between a thread tensioner 32 and the orifice 26 of the thread feeder 28. In FIG. 1 the thread feeder is illustrated in the top dead canter position 33 at which stitching thread 12 contacts the thread guide 24 or pin 25.

Attached to a bracket 34 by means of a screw 35, in a height adjustable manner, is a U-shaped curved thread guide 36. The U-shaped curved thread guide 36 includes a U-curve 37 formed therein that guides the stitching thread 12 in the top dead center position 33 without the stitching thread 12 being deflected transverse to its path.

A thread guide 39, which can be adjusted by means of a screw 38, is disposed in the region of the thread tensioner 32 and during the entire stitch forming procedure the said thread guide 39 is in contact with the stitching thread 12 and improves the manner in which the stitching thread 12 is guided in the thread tensioner 32. This guiding procedure is also assisted by a tube 41 which guides the stitching thread 12 as it is drawn off from the thread supply towards the thread tensioner 32.

The thread feeder 28 which guides the stitching thread 12 is in the form of a pivot arm 42 which carries the eyelet 27 at is free end and is attached by means of a screw 43 to a oscillating shaft 44 in such a manner as to be able to adjust the angle of rotation.

FIG. 2 illustrates the thread feeder 28 in its bottom dead center position 45. In this position the stitching thread 12 continues to contact the thread guides 24 and 39, but now in addition contacts the thread guide 29, disposed in the region of the bottom dead center position 45 of the thread feeder 28 at the holder 22. At the bottom dead center position, the stitching thread is in contact with the thread guide 29 or pin 31 as well as the thread guide 36 and the lower part of the U-curve 37, which causes the stitching thread 12 to be deflected transverse to its path. As a consequence, the stitching thread 12 contacts the fixed thread guides 29 and 36 at least in parts of the stitch formation procedure. This contact occurs after leaving the top dead center position 33 of the thread feeder 28 and continues until prior to again reaching the top dead center position 33.

Figure 4:
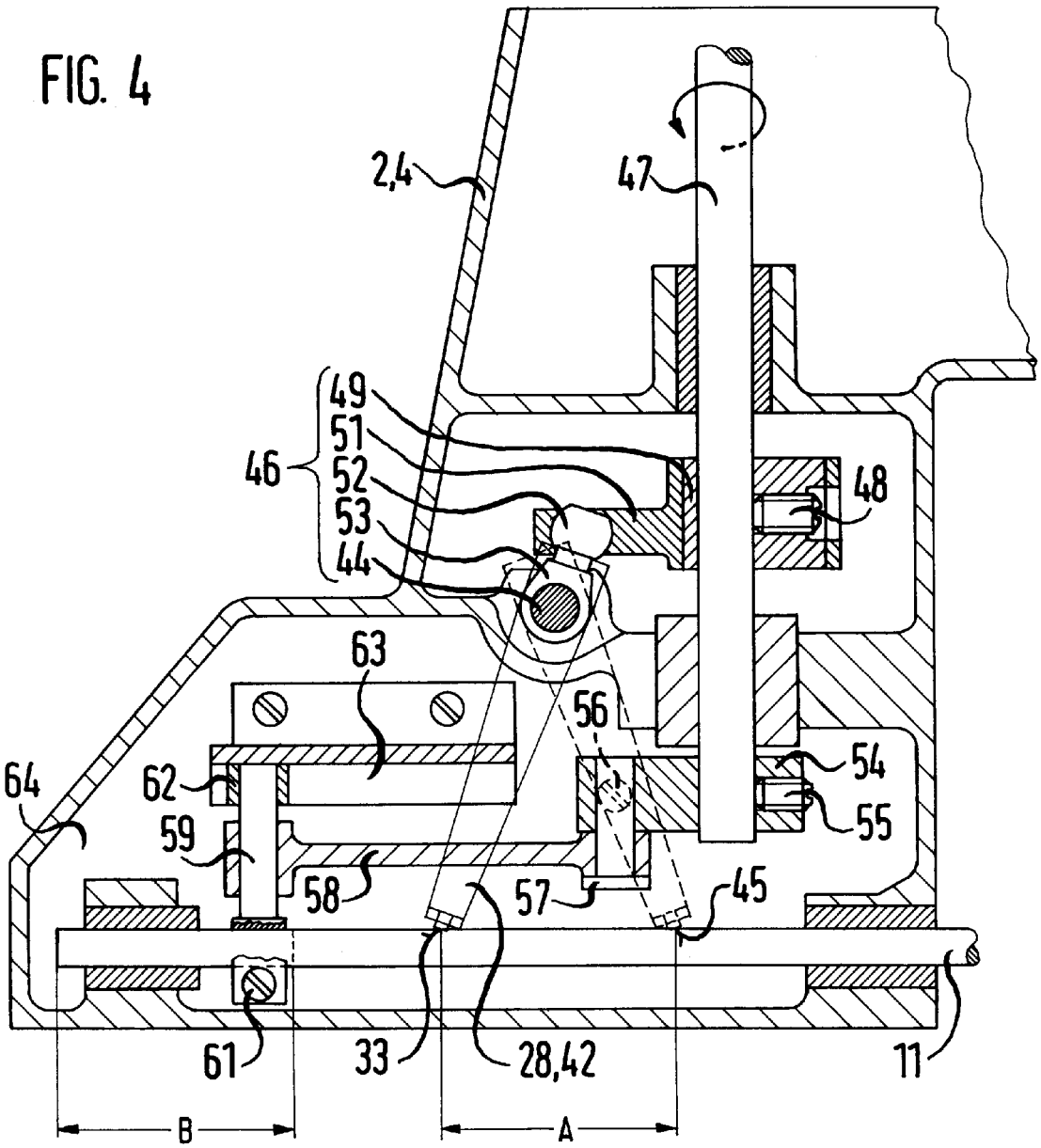
FIG. 4 shows an exploded partial front view, of the thread feeder and needle bar in the top dead center position.

FIG. 4 illustrates the drive means of the needle bar 11, which along with stitching needle 9 moves in a reciprocating manner. This figure also illustrates the pivot drive 46 of the thread feeder 28 which moves simultaneously. The upper arm casing 4 supports a rotatably mounted shaft 47 which is allocated to the pivot drive 46 carrying the thread feeder 28 which enables the thread feeder 28 to move in an oscillating manner relative to the movement of the stitching needle 9. The pivot drive 46 comprises an eccentric 49 which is attached to the shaft 47 by means of a screw 48, the said eccentric being encompassed by an axially displaceable rocker arm 51 which encircles at its free end a sphere 52 of a carrier 53 attached to the oscillating shaft 44.

The shaft 47 carries at its end adjacent the needle bar 11 an eccentric holder 54 which is attached to the shaft 47 by means of a screw 55. A collar stud 57 attached to a threaded pin 56 in the eccentric holder 54 supports a guide rod 58 which for its part drives a needle bar entrainer 59 which moves the needle bar 11 in a reciprocating manner and which needle bar entrainer is attached by means of a screw 61 to the needle bar 11 and glides by means of a sleeve 62 in a straight guide 63.

As seen in FIG. 4, the letter A illustrates clearly the effective path of the thread feeder 28 from the to dead center position 33 to the bottom dead center position 45 of the thread feeder 28. The letter B illustrates the stroke of the needle bar 11 and of the stitching needle 9.

The effective path of the thread feeder 28 and the stroke of the stitching needle 9 are designed approximately in the ratio of 1:1, wherein the stroke is approximately 80 millimeters. The upper end of the needle bar 11, that is opposite the stitching needle 9, is located in an inner region 64 of the upper arm casing 4.

The at least one thread guide 29, 36 arranged between the thread tensioner 32 and the orifice 26 of the oscillating thread feeder 28 renders it possible to carry out further fine adjustments to the quantity of thread required during the stitch forming procedure, so that only the required quantity of stitching thread 12 necessary to form the stitch is drawn off from the thread supply through thread tensioner 32. This makes it possible to reduce the tension in the stitching thread 12, necessary for the stitch formation, to approximately half the normally required thread tension.

Furthermore, in an advantageous manner the at least one thread guide 29, 36 improves the manner in which the formed stitch is tightened, so that it is possible to produce a more compact seam, i.e. the stitching thread 12 is tightened more firmly in the formed seam. The fixed thread guide 24 and the pin 25 enhance this effect.

We claim:

1. A thread control device for a chainstitch sewing machine of the type having a lower casing and an upper arm casing including a rotatably mounted shaft, a reciprocating needle bar having a stitching needle including an eye through which the stitching thread is threaded, drive means connecting said rotatably mounted shaft to said reciprocating needle bar, a thread tensioning device and a thread feeder including a thread-guiding orifice wherein the improvement comprises:

a thread feeder shaft mounted perpendicular to said rotatably mounted shaft for oscillation in said upper arm casing, said thread feeder shaft including a free end portion located exteriorly of said upper arm casing;

said thread feeder including a thread-guiding orifice mounted on said free end portion;

a pivot drive connecting said thread feeder shaft to said rotatably mounted shaft for imparting oscillating movement to said thread feeder shaft such that said thread guiding orifice oscillates relative to the reciprocating movement of said stitching needle;

said pivot drive connecting said thread feeder shaft to said rotatably mounted shaft being completely enclosed within said upper arm casing;

a fixed thread guide mechanism fixed to said upper arm casing at a location between said thread tensioning device and the arc along which the orifice of said thread feeder oscillates;

thread guide mechanism carried by said upper arm casing that causes said stitching thread exiting from said orifice of the thread feeder to be deflected directly towards said stitching needle; and a looper mounted in said lower casing.

2. A thread control device according to claim 1 wherein the improvement further comprise means for adjusting said fixed thread guide mechanism in a direction transverse to the path of the stitching thread.

3. A thread control device according to claim 2, wherein the improvement further comprises locating said fixed guide mechanism such that it is in contact with said stitching thread during at least a portion of the stitch forming procedure.

4. A thread control device according to claim 1, wherein the improvement further comprises a second fixed thread mechanism, carried by said upper arm casing, that is in contact with said stitching thread during at least a portion of the stitch forming procedure.

5. A thread control device according to claim 1, wherein the improvement further comprises locating said fixed thread guide mechanism such that it is in contact with said stitching thread during at least a portion of the stitch forming procedure.

6. The thread control device according to claim 1, wherein the improvement further comprises an oscillating shaft, said thread feeder being adjustably connected to said oscillating shaft.

7. A thread control device for a chainstitch sewing machine of the type having a lower casing and an upper arm casing including a rotatably mounted shaft, a reciprocating needle bar having an upper end and a lower end, a stitching needle including an eye through which the stitching thread is threaded connected to said lower end of the needle bar, drive means connecting said rotatably mounted shaft to said reciprocating needle bar, a thread tensioning device and a thread feeder including a thread-guiding orifice wherein the improvement comprises:

a thread feeder shaft mounted perpendicular to said rotatably mounted shaft for oscillation in said upper arm casing, said thread feeder shaft including a free end portion located exteriorly of said upper arm casing;

said thread feeder including a thread-guiding orifice carried by said free end portion;

said upper end of the needle bar being completely enclosed within said upper arm casing;

a pivot drive, that is completely enclosed within said upper arm casing, connecting said thread feeder shaft to said rotatably mounted shaft for imparting oscillating movement to said thread feeder shaft such that said thread guiding orifice oscillates relative to the reciprocating movement of said stitching needle;

said pivot drive for said thread feeder imparts an effective path to said thread feeder and said drive means for said needle bar imparts an effective stroke to said needle bar and the ratio of said effective path for said thread feeder to the effective stroke of the needle bar is approximately 1:1; and a looper mounted in said lower casing.

8. A thread control device according to claim 7, wherein the improvement further comprises guide means that causes said stitching thread exiting from said orifice of the thread feeder to be deflected directly towards said stitching needle.

9. A thread control device according to claim 7, wherein the improvement further comprises a fixed thread guide arranged between said thread tensioning device and said orifice of the oscillating thread feeder in the path of the stitching thread.

10. A thread control device according to claim 7 wherein the improvement further comprise means for adjusting said fixed thread guide mechanism in a direction transverse to the path of the stitching thread.

11. A thread control device for a chainstitch sewing machine of the type having an upper arm casing including a rotatably mounted shaft, a reciprocating needle bar having a stitching needle including an eye through which the stitching thread is threaded, drive means connecting said rotatably mounted shaft to said reciprocating needle bar, a thread tensioning device and a thread feeder including a thread-guiding orifice wherein the improvement comprises:

a pivot drive connecting said thread feeder to said rotatably mounted shaft for imparting oscillating movement to said thread feeder such that said thread guiding orifice oscillates relative to the reciprocating movement of said stitching needle;

a fixed thread guide disposed between said stitching needle and said thread-guide disposed between said stitching needle and said thread-guiding orifice of the thread feeder in the path of the stitching thread; and means for adjusting sails fixed thread guide disposed between said stitching needle and said thread-guiding orifice of the thread feeder in a direction substantially parallel to the stitching thread.

12. A thread control device for a chainstitch sewing machine of the type having a lower casing and an upper arm casing including a rotatably mounted shaft, a reciprocating needle bar having a stitching needle including an eye through which the stitching thread is threaded, drive means connecting said rotatably mounted shaft to said reciprocating needle bar, a thread tensioning device and a thread feeder including a thread-guiding orifice wherein the improvement comprises:

a pivot drive connecting said thread feeder to said rotatably mounted shaft for imparting oscillating movement to said thread feeder such that said thread guiding orifice oscillates relative to the reciprocating movement of said stitching needle;

a fixed thread guide mechanism fixed to said upper arm casing at a location between said thread tensioning device and the arc along which the orifice of said thread feeder oscillates;

thread guide mechanism carried by said upper arm casing that causes said stitching thread exiting from said orifice of the thread feeder to be deflected directly towards said stitching needle;

a looper mounted in said lower casing; and means for adjusting said thread guide mechanism that causes said stitching thread to extend from said orifice of the thread feeder to be deflected directly toward said stitching needle in a direction substantially parallel to the stitching thread.

13. A thread control device for a chainstitch sewing machine of the type having a lower casing and an upper arm casing including a rotatably mounted shaft, a reciprocating needle bar having a stitching needle including an eye through which the stitching thread is threaded, drive means connecting said rotatably mounted shaft to said reciprocating needle bar, a thread tensioning device and a thread feeder including a thread-guiding orifice wherein the improvement comprises:

a pivot drive connecting said thread feeder to said rotatably mounted shaft for imparting oscillating movement to said thread feeder such that said thread guiding orifice oscillates relative to the reciprocating movement of said stitching needle;

a fixed thread guide mechanism fixed to said upper arm casing at a location between said thread tensioning device and the arc along which the orifice of said thread feeder oscillates;

thread guide mechanism carried by said upper arm casing that causes said stitching thread exiting from said orifice of the thread feeder to be deflected directly towards said stitching needle;

a looper mounted in said lower casing; and said upper arm casing including an inner region and wherein the end of said needle bar lying opposite said stitching needle is arranged in said inner region of the upper arm casing and the other end of said needle bar that supports said stitching needle protrudes out of said upper arm casing.

14. A thread control device for a chainstitch sewing machine of the type having a lower casing and an upper arm casing including a rotatably mounted shaft, a reciprocating needle bar having a stitching needle including an eye through which the stitching thread is threaded, drive means connecting said rotatably mounted shaft to said reciprocating needle bar, a thread tensioning device and a thread feeder including a thread-guiding orifice wherein the improvement comprises:

a pivot drive connecting said thread feeder to said rotatably mounted shaft for imparting oscillating movement to said thread feeder such that said thread guiding orifice oscillates relative to the reciprocating movement of said stitching needle;

said pivot drive for said thread feeder imparts an effective path to said thread feeder and said drive means for said needle bar imparts an effective stroke to said needle bar and the ratio of said effective path for said thread feeder to the effective stroke of the needle bar is approximately 1:1;

a looper mounted in said lower casing;

a fixed thread guide disposed between said stitching needle and said thread-guiding orifice of the thread feeder in the path of the stitching thread;

a thread guide mechanism that causes said stitching thread to extend from said orifice of the thread feeder to be deflected directly toward said stitching needle in a direction substantially parallel to the stitching thread; and means for adjusting said thread guide mechanism.

* * * * *

UNITED STATES PATENT AND TRADEMARK OFFICE

CERTIFICATE OF CORRECTION

PATENT NO. : 5,899,156

DATED : May 4, 1999

INVENTOR(S) : Dieter Schopf et al.

It is certified that error appears in the above-indentified patent and that said Letters Patent is hereby corrected as shown below:

Claim 11, Col. 5, line 53 - change "sails" to -- said --.

Signed and Sealed this

Twenty-eighth Day of March, 2000

*Attest:*

Q. TODD DICKINSON

*Attesting Officer*

*Commissioner of Patents and Trademarks*

UNITED STATES PATENT AND TRADEMARK OFFICE

CERTIFICATE OF CORRECTION

PATENT NO. : 5,899,156

DATED : May 4, 1999

INVENTOR(S) : Dieter Schopf et al.

It is certified that error appears in the above-identified patent and that said Letters Patent is hereby corrected as shown below:

Claim 2, Col. 4, line 36 - change "comprise" to -- comprises --.

Claim 10, Col. 5, line 32 - change "comprise" to -- comprises --.

Signed and Sealed this

Ninth Day of May, 2000

*Attest:*

Q. TODD DICKINSON

*Attesting Officer*

*Director of Patents and Trademarks*